US006112330A

United States Patent [19]

Bryan

[11] Patent Number: 6,112,330

[45] Date of Patent: Sep. 5, 2000

[54] DEVICE FOR ATTACHED A BELL, A BEEPER, OR A SIGNALING WHISTLE TO SPORT HAND PROTECTOR OR THE LIKE

[76] Inventor: Thomas Bryan, Trautenwolfstr. 2, 80802 Munich, Germany

[21] Appl. No.: 08/937,731

[22] Filed: Sep. 25, 1997

[30] Foreign Application Priority Data

Sep. 27, 1996 [DE] Germany ..... 196 39 958
Jul. 30, 1997 [EP] European Pat. Off. ..... 97113125

[51] Int. Cl.[7] ..... A41D 19/00

[52] U.S. Cl. ..... 2/160; 116/137 R

[58] Field of Search ..... 2/16, 159, 160, 2/161.1, 161.5, 163; 116/137 R, 171, DIG. 1; 472/133; 434/247; 446/26, 397, 404, 416, 204, 216

[56] References Cited

U.S. PATENT DOCUMENTS

| | | | |
|---|---|---|---|
| 1,258,077 | 3/1918 | Worchester | 446/26 |
| 1,548,628 | 8/1925 | Petrie | 446/26 |
| 2,780,954 | 2/1957 | Bryce | 84/375 |
| 2,902,693 | 9/1959 | Wells, Jr. | 2/158 |
| 3,027,794 | 4/1962 | Chute | 84/406 |
| 4,392,325 | 7/1983 | Woronets | 446/26 |
| 4,625,339 | 12/1986 | Peters | 2/160 |
| 4,704,743 | 11/1987 | Thornell et al. | 2/159 |
| 5,345,368 | 9/1994 | Huff | 362/103 |
| 5,542,125 | 8/1996 | Zuckerwar | 2/158 |
| 5,558,550 | 9/1996 | Setteducati | 446/26 |

*Primary Examiner*—Michael A. Neas

[57] ABSTRACT

The invention concerns a device for attaching a bell or the like to a sport hand protector or a sport glove. The device comprises a fixing part (1) which is removably or irremovably connected with a finger part (8) and on which the bell (30) or the like can be removably or irremovably mounted. The finger part (8) is removably attachable to the sport hand protector, the sport glove or the like. It is the core of the device of the present invention to provide a sportsman such as an in-line-skater with a warning device which can be easily removed from the finger or the sport hand protector so that the latter can be worn with or without said reliably fixed device and that said device can also be worn without the sport hand protector (FIG. 6A).

17 Claims, 7 Drawing Sheets

DEVICE FOR ATTACHED A BELL, A BEEPER, OR A SIGNALING WHISTLE TO SPORT HAND PROTECTOR OR THE LIKE

BACKGROUND OF THE INVENTION

The invention concerns a device for attaching a bell, a beeper or a signalling whistle to a sport hand protector or the like.

PRIOR ART

Up to now, the only possible way for in-line-skaters, snowboarders and skiers to gain attention when facing an obstacle has been by shouting or with the help of a signalling whistle hanging around their necks or at their backpacks.

The shouting can be misunderstood, is tiring and the whistle is not always available quickly enough.

Although cyclists mostly have a bell at their handlebars, a bell, a whistle or a beeper being attached to a finger of a hand protector of a racing cyclist or a mountainbike cyclist can meet the requirement of a quicker and easier access to the bell.

U.S. Pat. No. 5,365,609 discloses a known golf glove where by means of foldable loops being fixed on the back of the glove markers or tees can be pinned onto the glove and carried along.

GB-2096882A discloses a glove with an integrated whistle and a flexible self-inflating airbag to operate the whistle.

SUMMARY OF THE INVENTION

It is an object of the present invention to provide a device for easily attaching a bell, a beeper or a signalling whistle or also a signalling lamp and easily removable to a sport hand protector or also without said hand protector directly to the finger of the left or the right hand.

According to the present invention this object is solved by a device for attaching a bell, a beeper, a signalling whistle or the like to a sport hand protector or sport glove, said device comprising a finger part which can be stuck on or wound around a finger of a person wearing said sport hand protector or sport glove and a fixing part on which the bell or the like can be mounted by first mounting means, wherein said fixing part comprises a mounting base surrounding a portion of said finger part and further second mounting means for mounting the fixing part on said finger part.

The advantages of the present invention are as follows:

As the bell, the signalling whistle or the beeper are attached directly to the finger, the hand protector or the glove, it is not necessary to look for them at the beginning of the sports activities.

The finger part can be easily removed from the rest of the sport hand protector or sport glove and can also be worn without it, especially on the forefinger.

Additionally, warning devices such as bells or the like, are available quickly and at any time during the sports activity, because they can be operated with the thumb respectively the whistle can be blown with the mouth in split seconds.

One embodiment having a fixing part which can be clicked on the hub which is fixed on the finger part surrounding the forefinger makes it possible that a bell, a beeper or a whistle can be alternatively and removably fixed.

By means of the additional fabric part which is stitched on the fabric or leather part surrounding the forefinger and which can be provided with an adjustable buckle, the device of the present invention can be easily adapted to the respective finger size of a user.

The device according to the invention provides protection for the user because collisions with pedestrians, cyclists and other sportsmen can be avoided because they are warned by the sound of the bell, the whistle or the beeper.

The first mounting means of the device according to the present invention can be made in such a way that both a removable as well as an irremovable fixing of the bell or the like on the fixing part are possible.

Furthermore, also the second mounting means can enable a removable or an irremovable fixing of the fixing part at the finger part.

On the other hand, the connecting means which are attached between the finger part and the rest of the sport hand protector provide anyway an easily removable connection for the finger part with the rest of the sport hand protector or sport glove. This advantageous development of the device according to the present invention makes it possible that the hand protector or the sport glove can also be worn without the bell, the beeper or the signalling whistle. Further, the uncomplicated removal of the finger section from the rest of the sport hand protector or glove makes an uncomplicated exchange of the bell, the beeper or the whistle construction possible, just by opening the zipper, the corresponding push-button parts or the VELCRO parts and by attaching another equipped finger part with the zipper or the like to the rest of the sport hand protector or the sport glove. Especially, when the sport hand protector or the sport glove is worn without the device according to the present invention, the fabric part which is fixed at the inner side of the rest of the sport hand protector can be folded over the zipper to the outside and there fixed with push-buttons so that the zipper is completely covered and cannot scratch the skin of the user.

Other advantages, features and objects of the present invention will be further clarified by the following description of several embodiments of the invention, especially when the description is read with reference to the Figures enclosed.

SHORT DESCRIPTION OF THE DRAWINGS

The Figures show in detail:

FIG. 1 diagrammatically and in a perspective view a first embodiment of the device according to the present invention with a removable bell, a beeper and a signalling whistle;

FIG. 2 also diagrammatically and in a perspective view the remaining part of the hand protector, where the finger part with the device according to the present invention has been removed;

FIG. 3 diagrammatically and in a perspective view a second embodiment of the device according to the present invention;

FIG. 4 a third embodiment of the device according to the present invention which is an alternative to the first and second embodiment;

FIG. 5 diagrammatically and perspectively an alternative embodiment of the first mounting means;

FIGS. 6A and 6B diagrammatically and perspectively an alternative form of the mounting of the mounting base on a different version of the finger part both mounted and not mounted; and FIGS. 7A and 7B the embodiment of the finger part shown in FIGS. 6A and 6B, both from above and below.

DETAILED DESCRIPTION OF THE PREFERRED EMBODIMENTS

Figure 1:
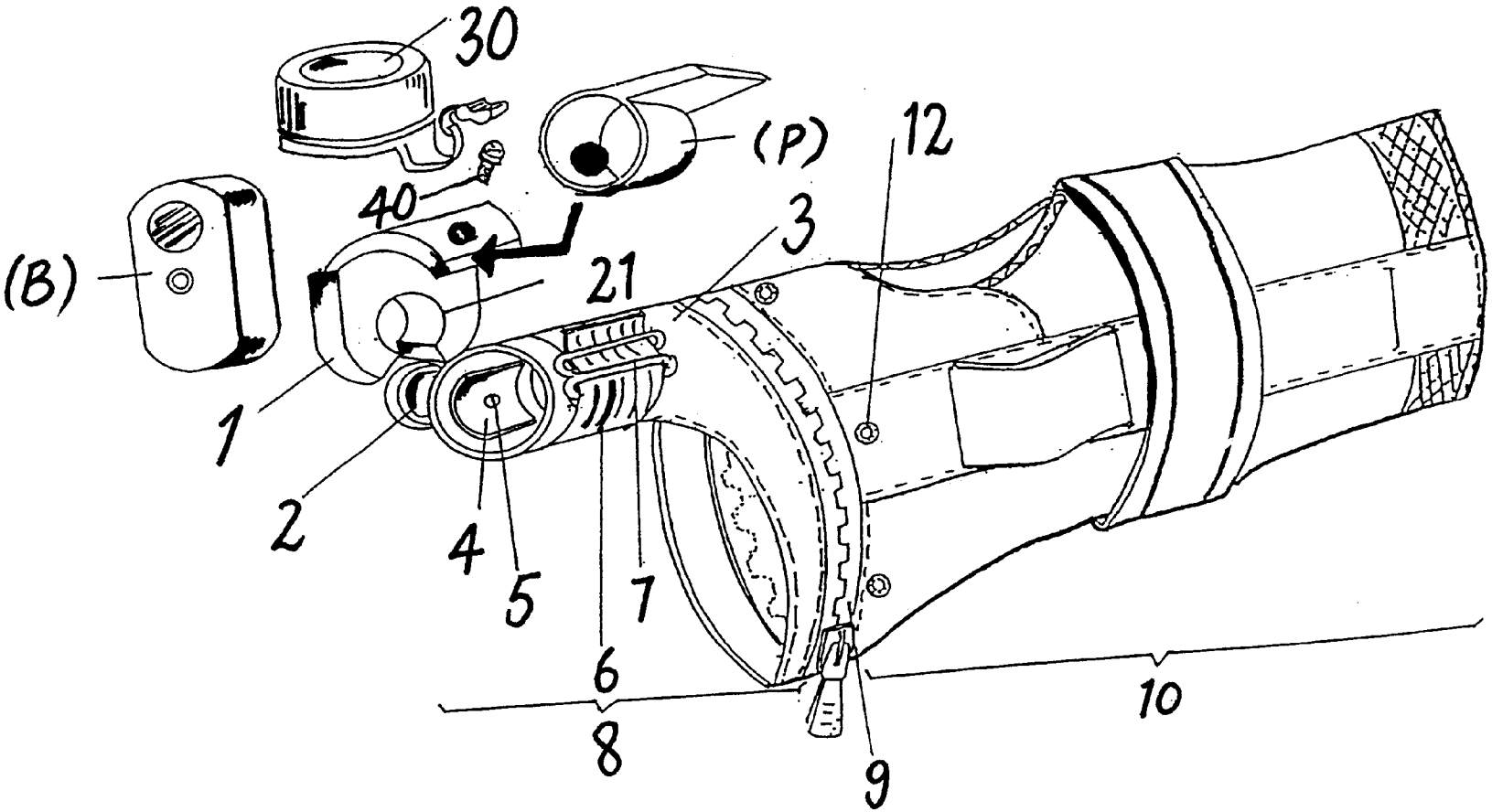

The first embodiment of the device according to the present invention as shown in FIG. 1 has a fixing part for attaching a bell 30, a beeper B, a signalling whistle P or the like to a finger part 8 with a mounting base 1 which partly surrounds the finger part 8. Mounting base 1 is fixed on the finger section 8 by the outside open and basically circular bore 21 said bore surrounding with its outer flexible end portions a hub 2 which is fixed at the finger part 8. The bore and said flexible end portions of the mounting base are adapted to the dimension of said hub so that the mounting base 1 can be fixed on said hub 2 by clicking it thereon.

Hub 2 is fixed by means of a part 4 of synthetic material and a screw 5 to a leather part or fabric part 3 surrounding the forefinger. Screw 5 which fixes hub 2 goes through a hole in the leather part or fabric part 3 and additionally through a second fabric part 6 which is stitched on said lower leather part or fabric part 3. The second fabric part 6 has a belt-like shape and is provided with an adjustable buckle 7 by means of which the finger part 8 can be adapted individually to the size of the forefinger, i.e. the dimensions of the forefinger. For this purpose only a middle section of the upper second fabric part 6 is stitched to the lower leather part or fabric part 3. The rest of the upper fabric part 6 remains free so that it can be closed with the adjustable buckle 7 and thus the size of the finger can be adapted.

In FIG. 1, the bell 30, the beeper B or the signalling whistle P can be fixed with a threaded bolt 40 on the fixing part 1 which has a bore in its upper part.

Furthermore, FIG. 1 shows as an embodiment of the connecting means a zipper 9 and push-button parts 12 which connect the finger section 8 with the rest of the sport hand protector 10 and whose purpose and function will be described below with reference to FIG. 2.

Figure 2:
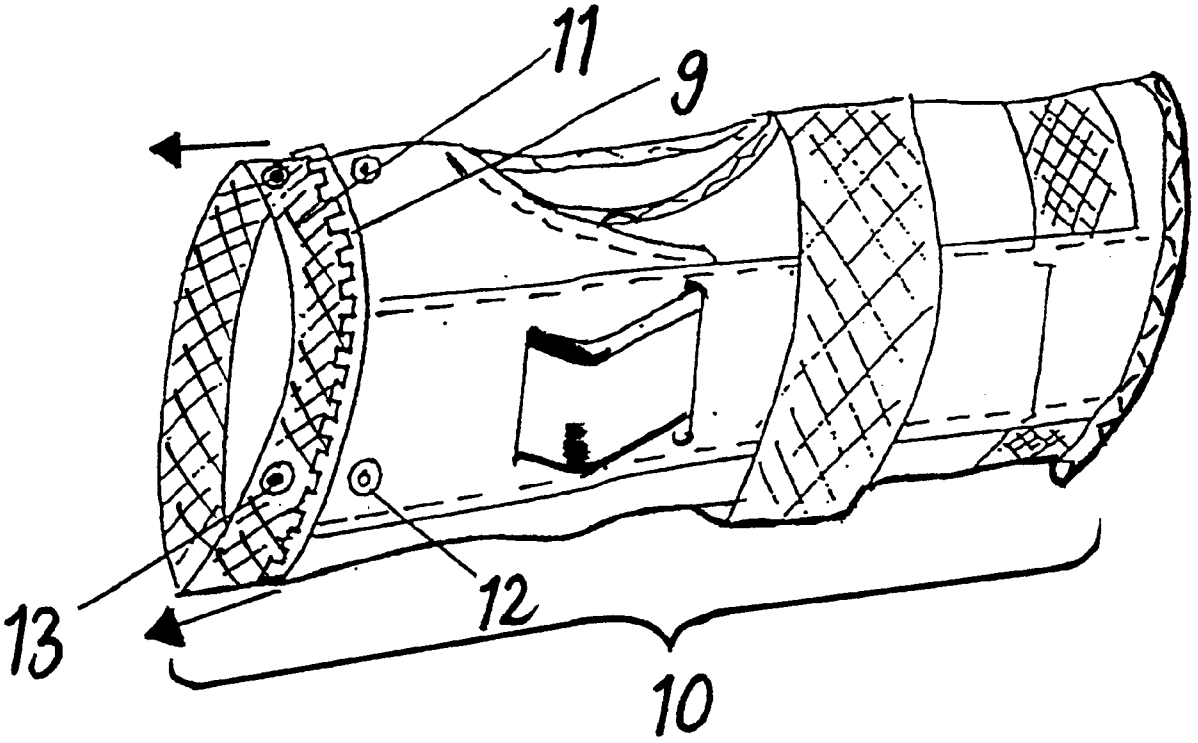

FIG. 2 which shows perspectively the rest of the sport hand protector 10 without the finger part 8 makes clear that a fabric part 11 is fixed at the inner side of the rest of the sport hand protector 10 to cover the zipper 10. Said fabric part 11 has push-button parts 13 corresponding with said push-buttons 12 which are fixed on the outside of the rest of the sport hand protector 10. The fabric part 11 can be folded over the zipper 9 to the outside and there be attached to the push-buttons 12 by its own push-buttons 13. Thus the zipper 9 is covered by the fabric part 11 and the hand of the user is protected.

Of course, the folding procedure of the fabric part 11 round the zipper 9 can also be carried out when the rest of the hand protector 10 is not yet put onto the hand but is unfolded and flat. In this state it is easier to fix the push-buttons 12 and 13 because the hand protector is not yet put on and both hands can be used.

Figure 3:
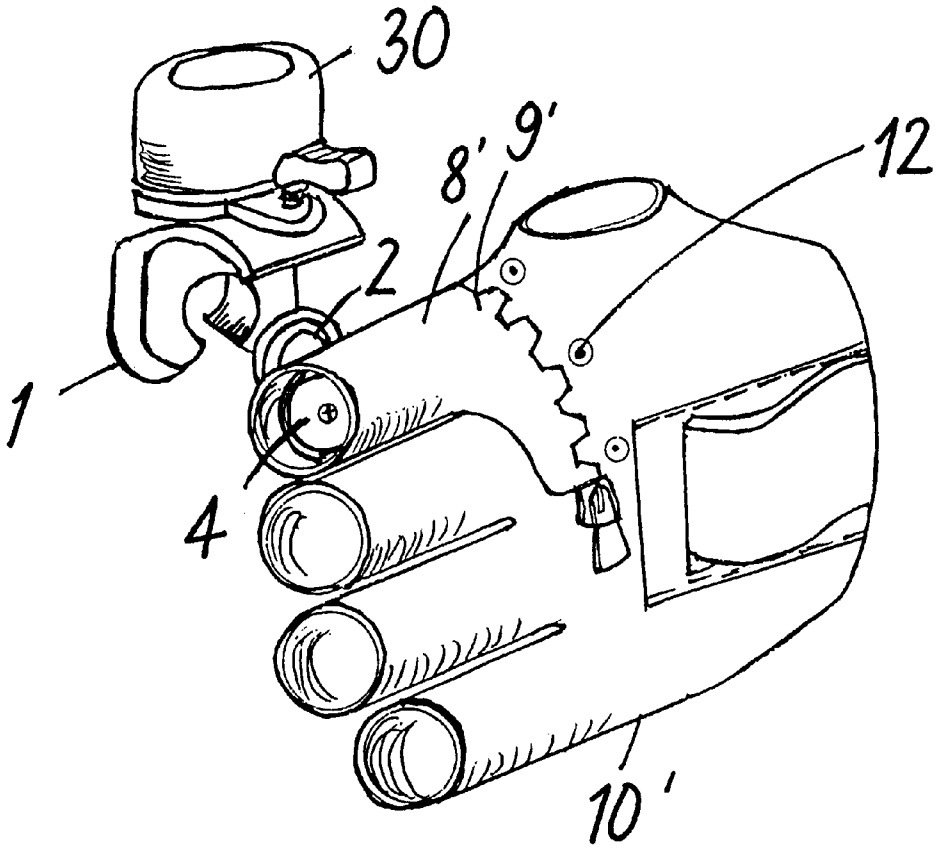

In FIG. 3 a second embodiment of the device according to the present invention is shown. In this embodiment the finger part 8' of the device according to the invention is only attached to the section of the rest of the hand protector 10' which surrounds the forefinger, because the rest of the hand protector 10' is already provided with finger parts for every finger with the exception of the forefinger. The other mounting means for mounting the bell 30 to the fixing part 1, the fixing part itself and the hub 2 which is attached to the finger part 8' can be identical with the first embodiment shown in FIG. 1. Due to clarity the belt-like fabric part 6 and the buckle 7 for adjusting the finger part 8' to the size of the forefinger are not shown in FIG. 8.

Figure 4:
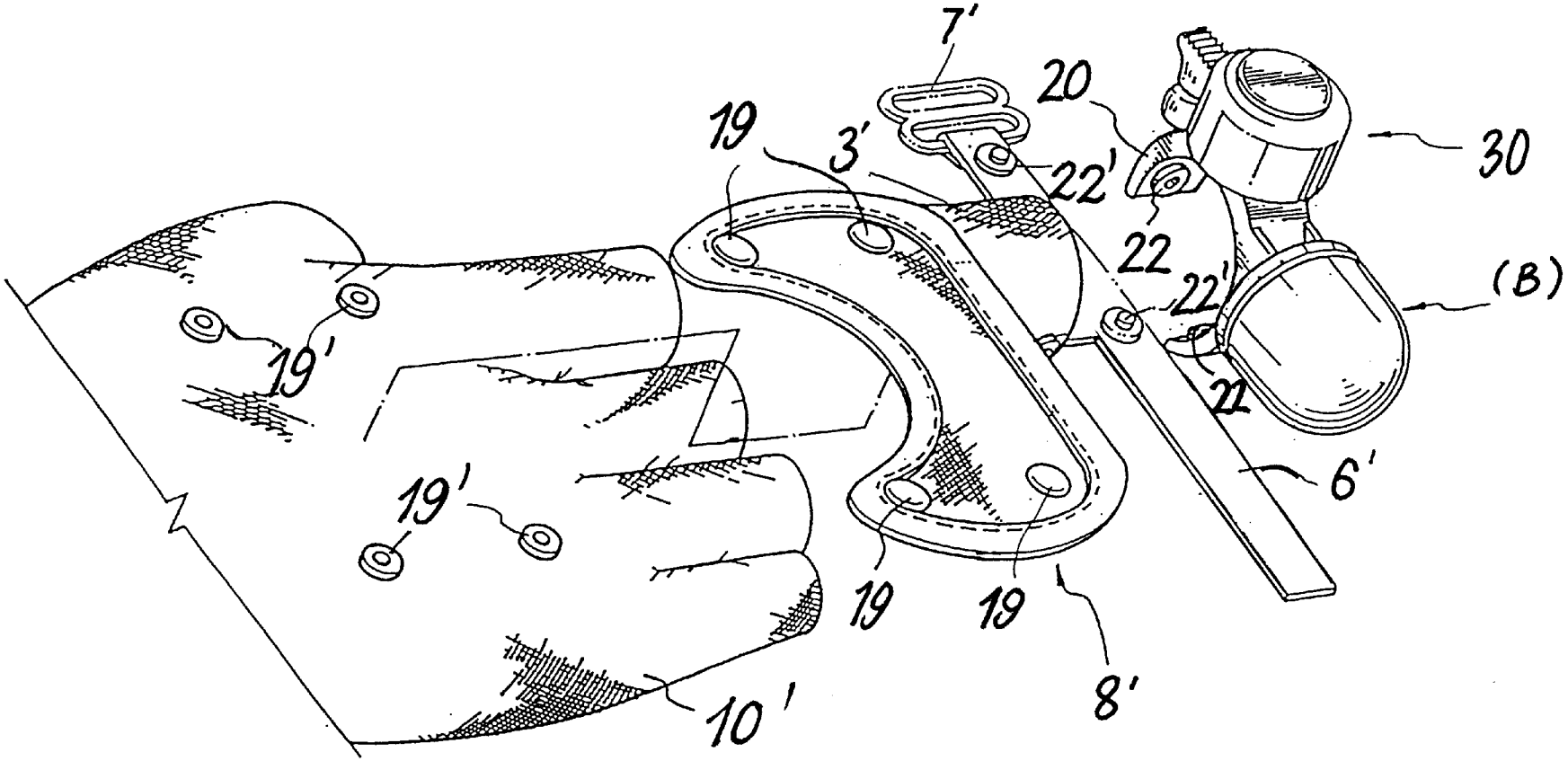

The third embodiment of the device according to the present invention shown in FIG. 4 depicts an alternative to the first and second embodiment. The finger part 8' is formed in such a way that it can be attached by push-buttons 19 to corresponding push-buttons 19' on the back of the hand of the rest of a hand protector 10'. In the course of this a tubular fabric part 3' of the finger part 8' comes to lie at the place of the forefinger. A belt-like formed outside leather part or fabric part 6' is wrapped round the forefinger, similar to the belt-like fabric part 6 in the embodiment shown in FIG. 1, and adapted to the dimensions of the forefinger by a buckle 7'. The belt-like outside fabric part 6' has push-button parts 22' on which corresponding push-button parts 22 can be clicked on which are on the underside of the fixing part 20 which is surrounding a part of the front finger part 3'.

Figure 5:
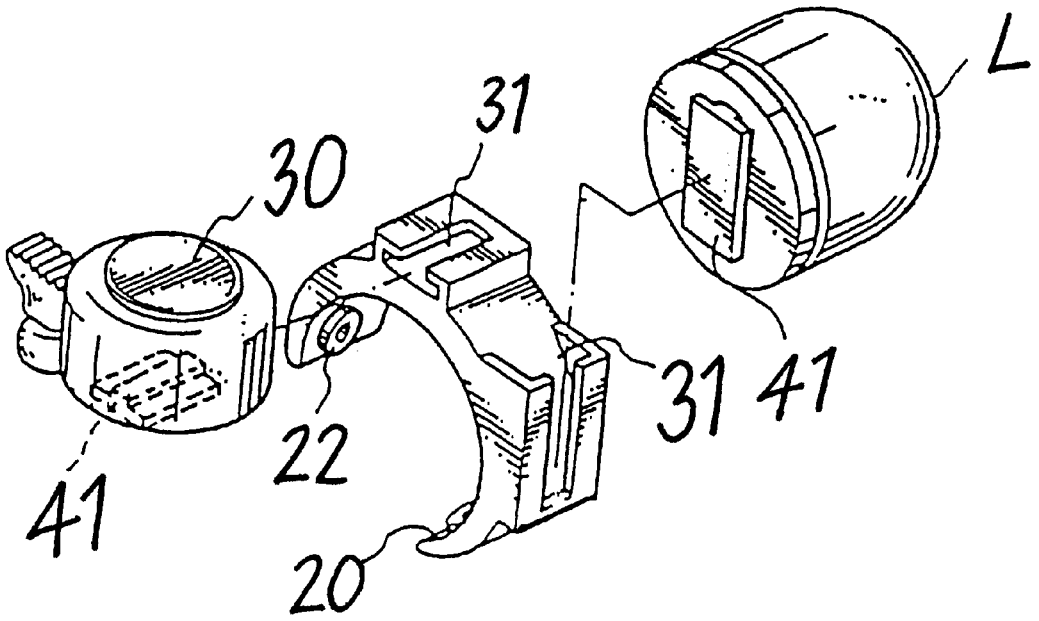

FIG. 5 shows in a perspective and exploded view an alternative embodiment of the mounting means (first mounting means) for mounting a bell 30, a beeper or a signalling lamp L on the outside of a differently designed mounting base 20. The bell 30 and/or the signalling lamp L can thus be attached to the mounting base 20 in such a way that they can be easily removed. The top side of the mounting base 20 which is formed as a section of an open flexible tube has clamping rails 31 and a bottom surface of the bell 30, the beeper and the signalling lamp L have clamp-type sockets 41 which can be clamped into the clamping rails 31. Of course, the arrangement of the clamp-type sockets and the clamping rails can also be exchanged so that the mounting base has a clamp-type socket and the bell, the signalling lamp L and the beeper have clamping rails. The openings of the clamping rails 31 are extending with an angle of 90° therebetween. The embodiment of the first mounting means with clamping rails and clamp-type sockets as shown in FIG. 5, enables an uncomplicated attachment and removal as well as an uncomplicated exchangeability of the signalling lamp L and the bell 30 at the mounting base 20.

Alternative embodiments which also enable an uncomplicated removal and exchangeability of the bell and/or the beeper at the mounting foot 20 have for example corresponding push-button parts on the underside of the bell and the beeper and on the top side of the mounting base 20, respectively.

Figure 6A:
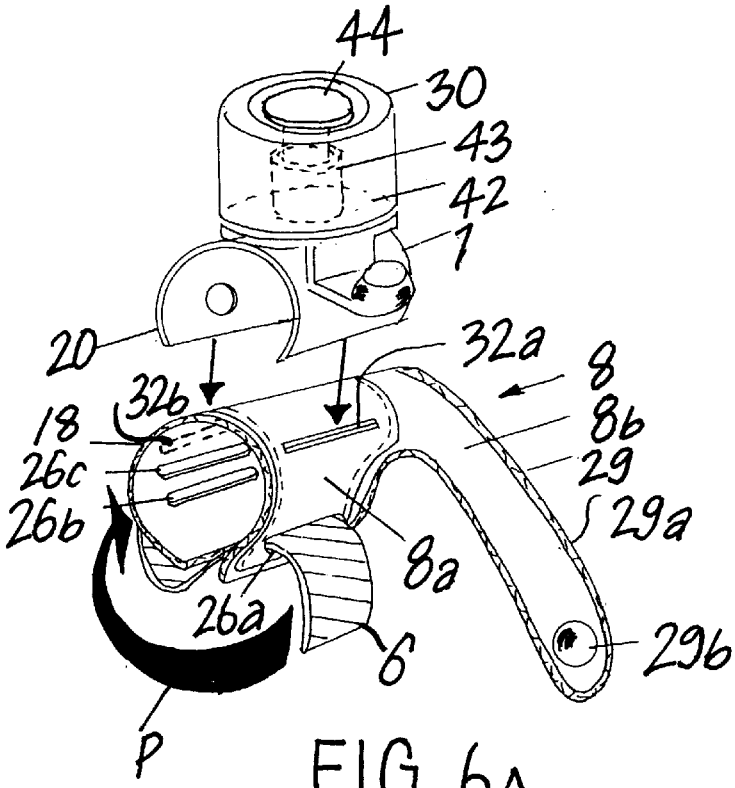
Figure 6B:
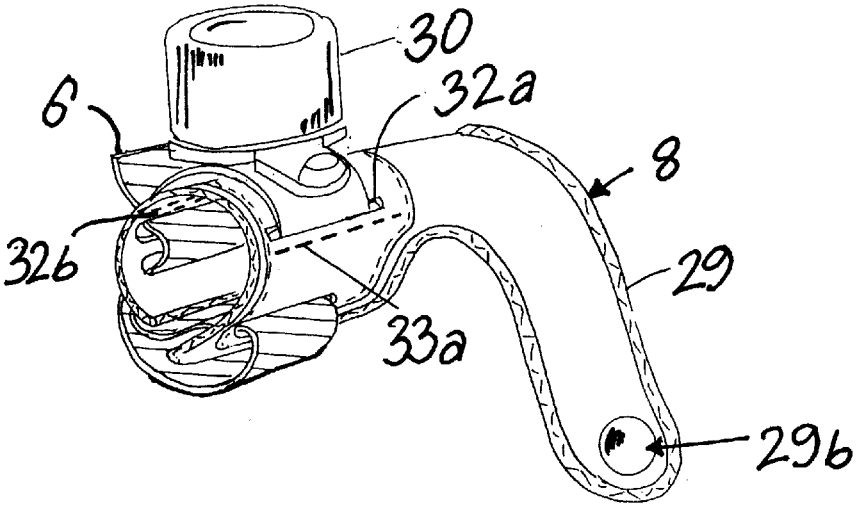

FIGS. 6A and 6B show a further embodiment of the device according to the present invention with which, as an example, a bell 30 is fixed on a finger part 8. First FIG. 6A makes clear that the fixing part 1 has a circular base plate 42 and a tubular post 43 rectangularity extending form the center of the base plate. The bell 30 is cylindrical, and the first mounting means consist of a plugging bolt which can be inserted through the center of said bell 30 and clamped into said tubular post 43.

Similar to the above described embodiment (FIG. 5), the mounting base 20 which forms a unit with the fixing part 1 is formed, by separate wall sections of an open flexible tube. The finger part 8 consists of an upper and a lower layer 8*a*, 8*b* of flexible material, for example of synthetic fabric material, and comprises two slits 32*a*, 32*b* in length direction, i.e. in the direction of the finger, whereas only slit 32*a* is shown in FIG. 6A. The width of said slits corresponds with the width of the free end of the tube section which forms the mounting base 20, and the distance of said slits 32*a* corresponds more or less with the distance between the open tube sections. Thus the ends of the mounting base 20 can be inserted through said slits 32*a*, 32*b* and stitched in this position on the finger part 8. In FIG. 6B only one stitching seam 33*a* is shown, although a second stitching seam connects in the same way the second end of the tube section with the finger part 8. This stitching seam is the easiest and cheapest way to fix the mounting base 20 on the finger part 8.

FIGS. 6A and 6B show further a fastening belt 6 which can be pulled through further slits 26*a*, 26*b* and 6*c*, in the same way as shown in FIG. 6B, to adapt the inner diameter of the finger part 8 to the diameter of the finger of a user and to fix it (see arrow P in FIG. 6A).

As described in the following with reference to FIGS. 7A and 7B, the above mentioned slits 32*a* do not pass through both layers of material 8*a* and 8*b* of the finger part 8 but only through the upper layer 8*a,* while the slits 26*a,* 26*b* and 26*c* through which the belt 6 is pulled pass through both layers 8*a* and 8*b*. FIGS. 6A and 6B further show a tongue-like connecting part 29 having first and second connecting means 29*a* and 29*b* which can be connected by complementary connecting means to the hand protector (not shown) to connect the finger part 8 with the hand protector.

Figure 7A:
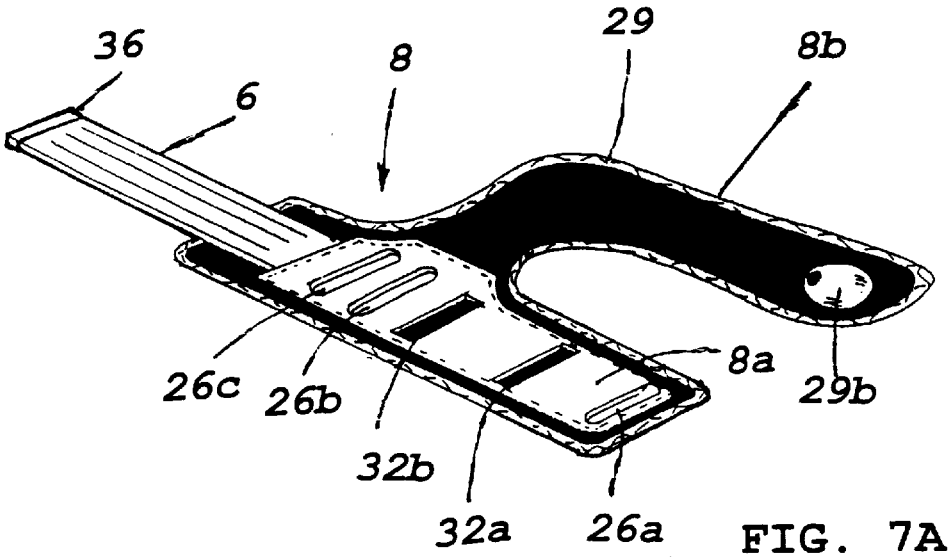
Figure 7B:
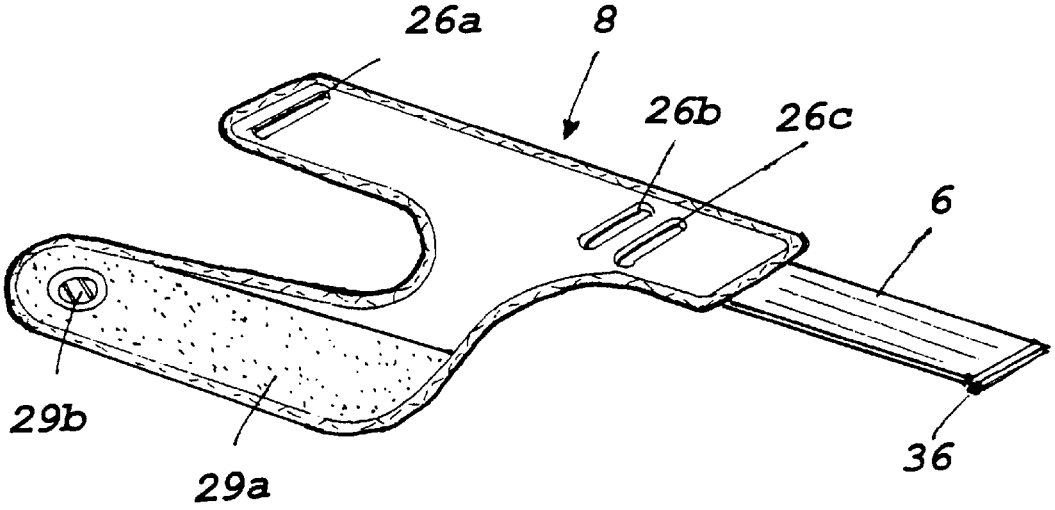

FIGS. 7A and 7B show perspectively the finger part 8 shown in FIGS. 6A and 6B in a plane view from the upper side and the bottom side, respectively. The finger part 8 consists basically of two layers 8*a,* 8*b* of flexible material such as fabric or leather stitched together along the stitching seam shown in FIG. 7A as an interrupted line. It is to be noted, that the upper layer of material 8*a* is connected with the lower layer 8*b* only along the stitching seam shown as interrupted line, otherwise it is free. The slits 26*a,* 26*b* and 26*c* through which the fastening belt 6 is pulled in the way as shown in FIG. 6B pass through both layers of material 8*a* and 8*b*. In contrast to that the parallel slits 32*a* and 32*b,* through which both ends of the mounting base 20 are stuck pass only through the upper material layer 8*a*.

The connecting tongue 29 providing the connecting means 29*a* and 29*b* has on its bottom side of the lower layer of material 8*b* (FIG. 7B) a VELCRO® hook and loop fastener part 29*a*. The other connecting means 29*b* is a push-button part. Complementary connecting means are respectively provided at the hand protector (not shown). The fastening belt 6 consists preferably of a length side rubber-elastic material, e.g. of a rubber-elastic fabric. Said rubber-elastic belt 6 is stitched between the upper layer of material 8*a* and the lower layer of material 8*b*.

Further, the rubber-elastic belt 6 can have a swelling 36 at its free end which prevents the rubber-elastic belt 6 from slipping out of through the slits 26*a* and 26*c* easily.

Of course, the finger part 8 of the embodiments shown in FIGS. 6A, 6B, 7A and 7B can have a zipper part—, e.g. as shown in FIG. 1 or in FIG. 3—as an alternative to the connecting means designed as push-button parts and VELCRO® hook and loop fastener parts.

It is to be noted that the push-button 29*b* may be unnecessary when a extremely strong velcro part 29*a* is chosen.

If it is not necessary to replace the bell, the beeper and the signalling lamp at the fixing part, the bell or the like can also be fixed at the fixing part by glue or rivet joints.

Instead of a removable mounting of the mounting base at the front part of the finger part, i.e. at the tubular part surrounding the finger, the mounting base can also be irremovably fixed on said tubular part. For this version e.g. rivet joints passing through the mounting base and the finger part are suitable.

It goes without saying that the device according to the present invention which is described above and illustrated with reference to the Figures, can be produced for a sport hand protector or sport glove both for the left hand and for the right hand. Of course, also the finger part 8' which is shown in FIG. 4 can be worn on a finger and can be adapted to the size of that finger. Further it is possible without any problems to prepare a (not shown) snowboard glove or skiing glove in such a way that the device of the present invention can be fixed on the snowboard glove or skiing glove, while the finger part has to be wrapped round the gloves finger e.g. for the forefinger and fixed. This can be done as it is e.g. shown in FIG. 4, or with the help of corresponding VELCRO parts.

What is claimed is:

1. A device for attaching a sound signalling means to a sport hand protector, said device comprising a finger part which can be secured to a finger of a person wearing said sport hand protector and a fixing part on which said sound signalling means can be mounted by first mounting means, wherein said fixing part comprises a mounting base surrounding a portion of said finger part and a second mounting means for mounting the fixing part on said finger part.

2. The device according to claim 1, wherein said sport hand protector comprises a finger part and a remaining part excluding said finger part, and wherein said finger part comprises first connection means which can be removeably connected with corresponding second connecting means at the remaining part of said sport hand protector.

3. The device according to claim 1, wherein said first mounting means comprises a threaded bolt for fixing the bottom of said sound signalling means to said fixing part.

4. The device according to claim 1, wherein said fixing part comprises a circular base plate and a tubular post rectangularly extending from the center of the base plate and wherein the first mounting means comprises a plugging bolt which can be inserted through the center of said sound signalling means and clamped into said tubular post.

5. The device according to claim 1, wherein said first mounting means comprises a clamp-type socket attached to a bottom side of said sound signalling means and clamping rails which are attached to an upper surface of said fixing part.

6. The device according to claim 1, wherein said first mounting means comprises a clamp-type socket attached to an upper surface of said fixing part of clamping rails attached to a bottom side of said sound signalling means.

7. The device of claim 1, wherein said first mounting means comprises corresponding first and second push-button parts on a bottom side of the sound signalling means and on an upper surface of said fixing part, respectively.

8. The device according to claim 1, wherein said first mounting means comprises a glue between a bottom part of said sound signalling means and an upper surface of said fixing part.

9. The device according to claim 1, wherein said first mounting means comprises a rivet joint for attaching a bottom side of said sound signalling means to said fixing part.

10. The device according to claim 1, wherein said second mounting means comprises a clicking closure by means of which said mounting base of said fixing part can be clicked on said finger part of said hand protector.

11. The device according to claim 10, wherein said clicking closure is formed by corresponding push-button parts.

12. The device according to claim 10, wherein said clicking closure comprises a hub mounted to said finger part and an open bore in said mounting base of said fixing part, having an outer flexible end portion, said bore and outer flexible end portion of said mounting base are adapted to the dimension of said hub so that the mounting base can be clicked on said hub, and wherein said hub is fixed by means of a plastic part and a screw to a lower part surrounding the forefinger of a person wearing said hand protector, said lower part which surrounds said finger can individually be adapted to the dimension of said finger in that a further part is stitched on said lower part and is provided with an adjustable buckle.

13. The device according to claim 1, wherein said mounting base is formed by separated wall sections of an open flexible tube, and said second mounting means is formed by at least one rivet joint passing through said mounting base of said fixing part and through said finger part.

14. The device according to claim 1, wherein said mounting base if formed by separated wall sections of an open flexible tube, and said finger part comprises one of slits and indentations in parallel to one another, the width of said slits or indentations being adapted to the width of ends of the wall sections of said open flexible tube and the distance of said slits or indentations is corresponding to the distance between said ends of said wall sections of said open flexible tube, so that these ends of the mounting base can be inserted through said slits or indentations of said finger part and stitched in this position by stitching seams forming said second mounting means.

15. The device according to claim 2, wherein said first and second connection means comprises a zipper provided between said finger part and the remaining part of said sport hand protector and wherein a part of fabric is attached to the interior of the remaining part of the sport hand protector, said part of fabric serving for covering said zipper and can be folded over the zipper portion at the remaining part of said sport hand protector and can be fixed to the outside of said sport hand protector by means of push-buttons when said finger part is not connected.

16. The device according to claim 2, wherein said first and second connection means comprises corresponding push-button portions at the remaining part of said hand protector and at said finger part.

17. The device according to claim 2, wherein said first and second connection means comprises corresponding hook and loop fastening means parts at the remaining part of said hand protector and at said finger part.

* * * * *